US009309595B2

(12) United States Patent
Steiger et al.

(10) Patent No.: US 9,309,595 B2
(45) Date of Patent: Apr. 12, 2016

(54) METHOD FOR THE PRODUCTION OF METAL OXIDE-CONTAINING LAYERS

(75) Inventors: Juergen Steiger, Duesseldorf (DE); Duy Vu Pham, Oberhausen (DE); Heiko Thiem, Bensheim (DE); Alexey Merkulov, Ludwigshafen (DE); Arne Hoppe, Herne (DE)

(73) Assignee: Evonik Degussa GmbH, Essen (DE)

( * ) Notice: Subject to any disclaimer, the term of this patent is extended or adjusted under 35 U.S.C. 154(b) by 807 days.

(21) Appl. No.: 13/390,840

(22) PCT Filed: Aug. 13, 2010

(86) PCT No.: PCT/EP2010/061836

§ 371 (c)(1),
(2), (4) Date: Apr. 5, 2012

(87) PCT Pub. No.: WO2011/020792

PCT Pub. Date: Feb. 24, 2011

(65) Prior Publication Data

US 2012/0181488 A1 Jul. 19, 2012

(30) Foreign Application Priority Data

Aug. 21, 2009 (DE) ..... 10 2009 028 802

(51) Int. Cl.
*C23C 18/12* (2006.01)

(52) U.S. Cl.
CPC ..... *C23C 18/1216* (2013.01); *C23C 18/1258* (2013.01)

(58) Field of Classification Search
CPC ..... C23C 18/1216; C23C 18/1258
USPC ..... 252/500
See application file for complete search history.

(56) References Cited

U.S. PATENT DOCUMENTS

| | | | |
|---|---|---|---|
| 5,237,081 | A | 8/1993 | Moore et al. |
| 2004/0043630 | A1 | 3/2004 | Vaartstra et al. |
| 2005/0287819 | A1 | 12/2005 | Vaartstra et al. |

(Continued)

FOREIGN PATENT DOCUMENTS

| | | | |
|---|---|---|---|
| DE | 10 2007 013 181 | | 9/2008 |
| EP | 200501916 | A1 | 6/2007 |

(Continued)

OTHER PUBLICATIONS

U.S. Appl. No. 13/391,114, filed Feb. 17, 2012, Steiger, et al.

(Continued)

*Primary Examiner* — Bijan Ahvazi
*Assistant Examiner* — Thuy-Ai Nguyen
(74) *Attorney, Agent, or Firm* — Oblon, McClelland, Maier & Neustadt, L.L.P.

(57) ABSTRACT

The invention relates to a liquid-phase method for producing metal oxide-containing layers from nonaqueous solution. In said method, an anhydrous composition containing i) at least one metal oxo-alkoxide of generic formula $M_xO_y(OR)_z[O(R'O)_cH]_aX_b[R''OH]_d$, where M=In, Ga, Sn, and/or Zn, x=3-25, y=1-10, z=3-50, a=0-25, b=0-20, c=0-1, d=0-25, R, R', R''=organic group, X=F, Cl, Br, I, and ii) at least one solvent is applied to a substrate, is optionally dried, and is converted into a metal oxide-containing layer. The invention also relates to the layers that can be produced using the method of the invention and to the use thereof.

13 Claims, 1 Drawing Sheet

Transfer characteristics for sample 1

(56) References Cited

U.S. PATENT DOCUMENTS

| | | | |
|---|---|---|---|
| 2008/0233378 | A1 | 9/2008 | Luthge et al. |
| 2010/0132788 | A1 | 6/2010 | Petrat et al. |
| 2011/0193084 | A1 | 8/2011 | Thiem et al. |
| 2011/0309313 | A1 | 12/2011 | Steiger et al. |
| 2011/0315982 | A1 | 12/2011 | Hoppe et al. |
| 2012/0213980 | A1 | 8/2012 | Arning et al. |

FOREIGN PATENT DOCUMENTS

| | | | |
|---|---|---|---|
| JP | 2004-231495 | A | 8/2004 |
| RU | 2 118 402 | C1 | 8/1998 |
| WO | 91 13848 | | 9/1991 |
| WO | 2010 094581 | | 8/2010 |
| WO | 2010 094583 | | 8/2010 |
| WO | 2011 072887 | | 6/2011 |
| WO | 2011 073005 | | 6/2011 |
| WO | 2012 010427 | | 1/2012 |
| WO | 2012 010464 | | 1/2012 |

OTHER PUBLICATIONS

U.S. Appl. No. 13/884,495, filed May 9, 2013, Steiger, et al.
U.S. Appl. No. 13/809,322, filed Jan. 9, 2013, Steiger, et al.
U.S. Appl. No. 13/809,423, filed Jan. 10, 2013, Steiger, et al.
U.S. Appl. No. 14/348,948, filed Apr. 1, 2014, Steiger, et al.
Kim, H.S., et al., "High Performance Solution-Processed Indium Oxide Thin-Film Transistors," Journal of the American Chemical Society, vol. 130, pp. 12580-12581, (Aug. 29. 2008).
International Search Report Issued Dec. 22, 2010 in PCT/EP10/61836 Filed Aug. 13, 2010.
U.S. Appl. No. 13/516,900, filed Jun. 18, 2012, Steiger, et al.
U.S. Appl. No. 13/515,007, filed Jun. 11, 2012, Steiger, et al.
U.S. Appl. No. 14/407,681, filed Dec. 12, 2014, Steiger, et al.

Transfer characteristics for sample 1
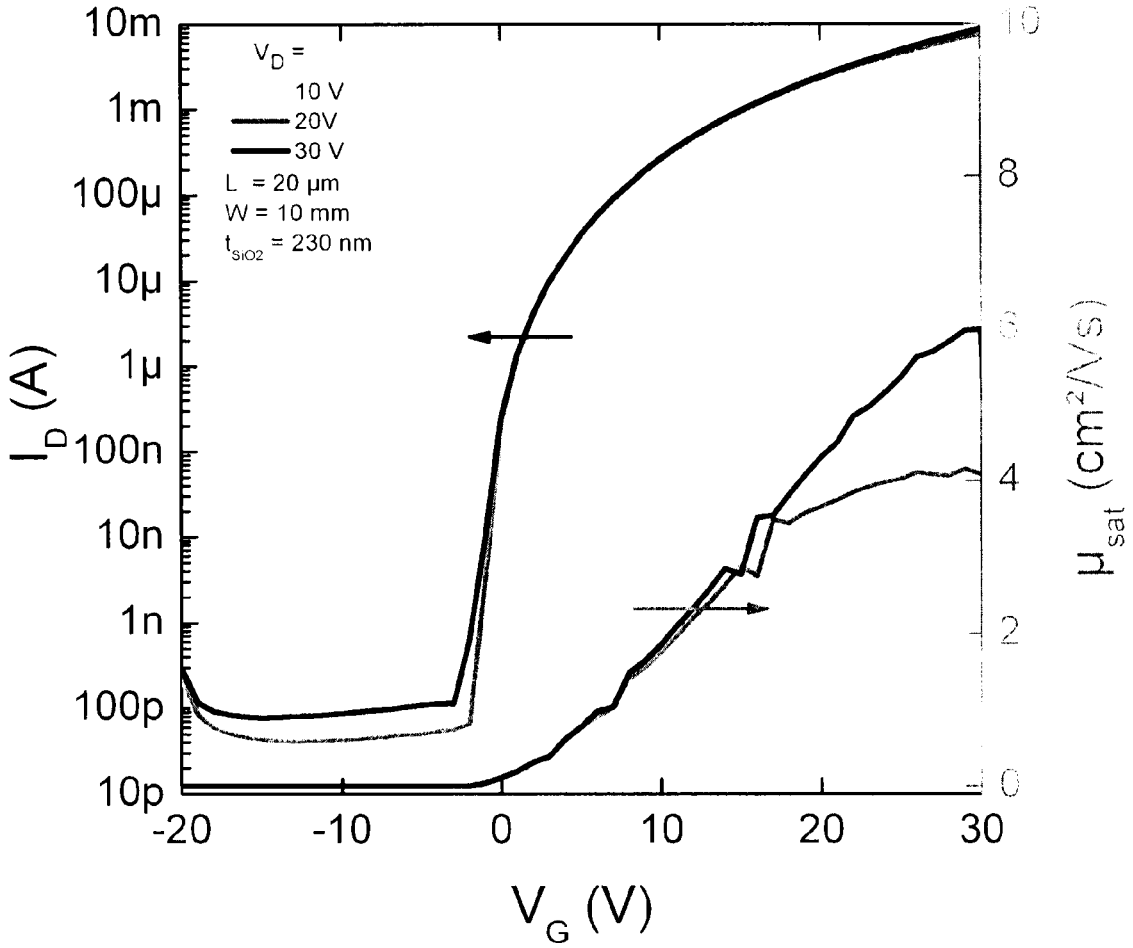

METHOD FOR THE PRODUCTION OF METAL OXIDE-CONTAINING LAYERS

The invention relates to a process for producing metal oxide-containing layers, to the layers producible by the process and to the use thereof.

Indium oxide (indium(III) oxide, $In_2O_3$), owing to the large band gap between 3.6 and 3.75 eV (measured for vapour-deposited layers) [H. S. Kim, P. D. Byrne, A. Facchetti, T. J. Marks; *J. Am. Chem. Soc.* 2008, 130, 12580-12581], is a promising semiconductor. Thin films of a few hundred nanometers in thickness may additionally have a high transparency in the visible spectral range of greater than 90% at 550 nm. In extremely highly ordered single indium oxide crystals, it is additionally possible to measure charge carrier mobilities of up to 160 $cm^2/Vs$.

Indium oxide is often used in particular together with tin (IV) oxide ($SnO_2$) as the semiconductive mixed oxide ITO. Owing to the comparatively high conductivity of ITO layers with the same transparency in the visible spectral range, one application thereof is in the field of liquid-crystal displays (LCDs), especially as a "transparent electrode". These usually doped metal oxide layers are produced industrially in particular by costly vapour deposition methods under high vacuum.

In addition to metal oxide-containing layers, especially indium oxide-containing layers and the production thereof, and among these ITO layers and pure indium oxide layers, are thus of great significance for the semiconductor and display industry.

Possible reactants and precursors discussed for the synthesis of metal oxide-containing layers include a multitude of compound classes. Examples for the synthesis of indium oxide include indium salts. For instance, Marks et al. describe components produced using a precursor solution composed of $InCl_3$ and the base monoethanolamine (MEA) dissolved in methoxyethanol. After spin-coating of the solution, the corresponding indium oxide layer is obtained by thermal treatment at 400° C. [H. S. Kim, P. D. Byrne, A. Facchetti, T. J. Marks; *J. Am. Chem. Soc.* 2008, 130, 12580-12581 and supplemental information].

Elsewhere, possible reactants or precursors discussed for the metal oxide synthesis are metal alkoxides. A metal alkoxide is a compound consisting of at least one metal atom, at least one alkoxide radical of the formula —OR (R=organic radical) and optionally one or more organic radicals —R, one or more halogen radicals and/or one or more —OH or —OROH radicals.

Independently of a possible use for metal oxide formation, the prior art describes various metal alkoxides and metal oxo alkoxides. Compared to the metal oxides already mentioned, metal oxo alkoxides also have at least one further oxygen radical (oxo radical) bound directly to an indium atom or bridging at least two indium atoms.

Mehrotra et al. describe the preparation of indium trisalkoxide $In(OR)_3$ from indium(III) chloride ($InCl_3$) with Na—OR where R is methyl, ethyl, isopropyl, n-, s-, t-butyl and pentyl radicals. [S. Chatterjee, S. R. Bindal, R. C. Mehrotra; *J. Indian Chem. Soc.* 1976, 53, 867].

A review article by Carmalt et al. (Coordination Chemistry Reviews 250 (2006), 682-709) describes various gallium(III) and indium(III) alkoxides and aryloxides, some of which may also be present with bridging by means of alkoxide groups. Additionally presented is an oxo-centred cluster of the formula $In_5(\mu\text{-}O)(O^iPr)_{13}$, more specifically $[In_5(\mu_5\text{-}O)(\mu_3\text{-}O^iPr)_4(\mu_2\text{-}O^iPr)_4(O^iPr)_5]$, which is an oxo alkoxide and cannot be prepared from $[In(O^iPr)_3]$.

A review article by N. Turova et al., Russian Chemical Reviews 73 (11), 1041-1064 (2004) summarizes synthesis, properties and structures of metal oxo alkoxides, which are considered therein as precursors for the production of oxidic materials via sol-gel technology. In addition to a multitude of other compounds, the synthesis and structure of $[Sn_3O(O^tBu)_{10}(^tBuOH)_2]$, of the already mentioned compound $[In_5O(O^iPr)_{13}]$ and of $[Sn_6O_4(OR)_4]$ (R=Me, $Pr^i$) are described.

The article by N. Turova et al., Journal of Sol-Gel Science and Technology, 2, 17-23 (1994) presents results of studies on alkoxides, which are considered therein as a scientific basis for the development of sol-gel processes of alkoxides and alkoxide-based powders. In this context, there is also discussion of a purported "indium isopropoxide", which was found to be the oxo alkoxide with a central oxygen atom and five surrounding metal atoms of the formula $M_5(\mu\text{-}O)(O^iPr)_{13}$ which is also described in Carmalt et al.

A synthesis of this compound and the crystal structure thereof are described by Bradley et al., J. Chem. Soc., Chem. Commun., 1988, 1258-1259. Further studies by the authors led to the result that the formation of this compound cannot be attributed to a hydrolysis of intermediately formed $In(O^iPr)_3$ (Bradley et al., Polyhedron Vol. 9, No. 5, pp. 719-726, 1990). Suh et al., J. Am. Chem. Soc. 2000, 122, 9396-9404 additionally found that this compound is not preparable by a thermal route either from $In(O^iPr)_3$. Moreover, Bradley (Bradley et al., Polyhedron Vol. 9, No. 5, pp. 719-726, 1990) found that this compound cannot be sublimed.

Metal oxide layers can in principle be produced via various processes.

One means of producing metal oxide layers is based on sputtering techniques. However, these techniques have the disadvantage that they have to be performed under high vacuum. A further disadvantage is that the films produced therewith have many oxygen defects, which make it impossible to establish a controlled and reproducible stoichiometry of the layers and hence lead to poor properties of the layers produced.

Another means in principle for producing metal oxide layers is based on chemical gas phase deposition. For example, it is possible to produce indium oxide-, gallium oxide- or zinc oxide-containing layers from precursors such as metal alkoxides or metal oxo alkoxides via gas phase deposition. For example U.S. Pat. No. 6,958,300 B2 teaches using at least one metal organo oxide precursor (alkoxide or oxo alkoxide) of the generic formula $M^1_q(O)_x(OR^1)_y$ (q=1-2; x=0-4, y=1-8, $M^1$=metal; e.g. Ga, In or Zn, $R^1$=organic radical; alkoxide when x=0, oxo alkoxide when ≥1) in the production of semiconductors or metal oxide layers by gas phase deposition, for example CVD or ALD. However, all gas phase deposition processes have the disadvantage that they require either i) in the case of a thermal reaction regime, the use of very high temperatures, or ii) in the case of introduction of the required energy for the decomposition of the precursor in the form of electromagnetic radiation, high energy densities. In both cases, it is possible only with a very high level of apparatus complexity to introduce the energy required to decompose the precursor in a controlled and homogeneous manner.

Advantageously, metal oxide layers are thus produced by means of liquid phase processes, i.e. by means of processes comprising at least one process step before the conversion to the metal oxide, in which the substrate to be coated is coated with a liquid solution of at least one precursor of the metal oxide and optionally dried subsequently. A metal oxide precursor is understood to mean a compound decomposable thermally or with electromagnetic radiation, with which metal oxide-containing layers can be formed in the presence or absence of oxygen or other oxidizing substances. Prominent examples of metal oxide precursors are, for example, metal alkoxides. In principle, the layer can be produced i) by sol-gel processes in which the metal alkoxides used are converted first to gels in the presence of water by hydrolysis and subsequent condensation, and then to metal oxides, or ii) from nonaqueous solution.

The production of metal oxide-containing layers from metal alkoxides from the liquid phase also forms part of the prior art.

The production of metal oxide-containing layers from metal alkoxides via sol-gel processes in the presence of significant amounts of water forms part of the prior art.

WO 2008/083310 A1 describes processes for producing inorganic layers or organic/inorganic hybrid layers on a substrate, in which a metal alkoxide (for example one of the generic formula $R^1M\text{-}(OR^2)_{y-x}$) or a prepolymer thereof is applied to a substrate, and then the resulting metal alkoxide layer is hardened in the presence of, and reacting with, water. The metal alkoxides usable may include those of indium, gallium, tin or zinc. However, a disadvantage of the use of sol-gel processes is that the hydrolysis-condensation reaction is started automatically by addition of water and is controllable only with difficulty after it has started. When the hydrolysis-condensation process is started actually before the application to the substrate, the gels obtained in the meantime, owing to their elevated viscosity, are often unsuitable for processes for obtaining fine oxide layers. When the hydrolysis-condensation process, in contrast, is started only after application to the substrate by supply of water in liquid form or as a vapour, the resulting poorly mixed and inhomogeneous gels often lead to correspondingly inhomogeneous layers with disadvantageous properties.

JP 2007-042689 A describes metal alkoxide solutions which may contain indium alkoxides, and also processes for producing semiconductor components which use these metal alkoxide solutions. The metal alkoxide films are treated thermally and converted to the oxide layer; these systems too, however, do not afford sufficiently homogeneous films. Pure indium oxide layers, however, cannot be produced by the process described therein.

DE 10 2009 009 338.9-43, which was yet to be published at the priority date of the present application, describes the use of indium alkoxides in the production of indium oxide-containing layers from anhydrous solutions. Although the resulting layers are more homogeneous than layers produced by means of sol-gel processes, the use of indium alkoxides in anhydrous systems still has the disadvantage that the conversion of indium alkoxide-containing formulations to indium oxide-containing layers does not give sufficiently good electrical performance of the resulting layer.

It is thus an object of the present invention to provide a process for producing metal oxide-containing layers, which avoids the disadvantages of the prior art. More particularly, a process which avoids the use of high vacuum shall be provided, in which the energy required for the decomposition and conversion of precursors and reactants can be introduced in a simple, controlled and homogeneous manner, which avoids the disadvantages of sol-gel techniques mentioned, and which leads to metal oxide layers with controlled, homogeneous and reproducible stoichiometry, high homogeneity and good electrical performance.

These objects are achieved by a liquid phase process for producing metal oxide-containing layers from nonaqueous solution, in which an anhydrous composition containing i) at least one metal oxo alkoxide of the generic formula $M_xO_y(OR)_z[O(R'O)_cH]_aX_b[R''OH]_d$ where M=In, Ga, Sn and/or Zn, x=3-25, y=1-10, z=3-50, a=0-25, b=0-20, c=0-1, d=0-25, R, R', R''=organic radical, X=F, Cl, Br, I and ii) at least one solvent are applied to a substrate, optionally dried, and converted to a metal oxide-containing layer.

The liquid phase process according to the invention for producing metal oxide-containing layers from nonaqueous solution is a process comprising at least one process step in which the substrate to be coated is coated with a liquid nonaqueous solution containing at least one metal oxide precursor and is optionally then dried. More particularly, it is not a sputtering, CVD or sol-gel process. A metal oxide precursor is understood to mean a compound decomposable thermally or with electromagnetic radiation, with which metal oxide-containing layers can be formed in the presence or absence of oxygen or other oxidizing substances. Liquid compositions in the context of the present invention are understood to mean those which are in liquid form under SATP conditions ("Standard Ambient Temperature and Pressure"; T=25° C. and p=1013 hPa) and on application to the substrate to be coated. A nonaqueous solution or an anhydrous composition is understood here and hereinafter to mean a solution or formulation which has not more than 200 ppm of $H_2O$.

The process product of the process according to the invention, the metal oxide-containing layer, is understood to mean a metal- or semimetal-containing layer which comprises indium, gallium, tin and/or zinc atoms or ions present essentially in oxidic form. Optionally, the metal oxide-containing layer may also comprise carbene, halogen or alkoxide components from an incomplete conversion or an incomplete removal of by-products formed. The metal oxide-containing layer may be a pure indium oxide, gallium oxide, tin oxide and/or zinc oxide layer, i.e. neglecting any carbene, alkoxide or halogen components may consist essentially of indium, gallium, tin and/or zinc atoms or ions present in oxidic form, or comprise proportions of further metals which may themselves be present in elemental or oxidic form. To obtain pure indium oxide, gallium oxide, tin oxide and/or zinc oxide layers, only indium-, gallium-, tin- and/or zinc-containing precursors should be used in the process according to the invention, preferably only oxo alkoxides and alkoxides. In contrast, to obtain layers comprising other metals in addition to the metal-containing precursors, it is also possible to use precursors of metals in the 0 oxidation state (to prepare layers containing further metals in uncharged form) or metal oxide precursors (for example other metal alkoxides or oxo alkoxides).

The metal oxo alkoxide is preferably one of the generic formula $M_xO_y(OR)_z$ in which, deviating from the above figures, x=3-20, y=1-8, z=1-25, OR=C1-C15-alkoxy, -oxyalkylalkoxy, -aryloxy or -oxyarylalkoxy group, and more preferably one of the generic formula $M_xO_y(OR)_z$ in which, deviating from the above figures, x=3-15, y=1-5, z=10-20, OR=—$OCH_3$, —$OCH_2CH_3$, —$OCH_2CH_2OCH_3$, —$OCH(CH_3)_2$ or —$O(CH_3)_3$.

Very particular preference is given to a process in which the metal oxo alkoxide used is $[In_5(\mu_5\text{-}O)(\mu_3\text{-}O^iPr)_4(\mu_2\text{-}O^iPr)_4(O^iPr)_5]$, $[Sn_3O(O^iBu)_{10}(^iBuOH)_2]$ and/or $[Sn_6O_4(OR)_4]$.

The present process according to the invention is particularly suitable for producing metal oxide layers when the metal oxo alkoxide is used as the sole metal oxide precursor. Very particularly good layers result when the sole metal oxide precursor is $[In_5(\mu_5\text{-}O)(\mu_3\text{-}O^iPr)_4(\mu_2\text{-}O^iPr)_4(O^iPr)_5]$, $[Sn_3O(O^iBu)_{10}(^iBuOH)_2]$ or $[Sn_6O_4(OR)_4]$. Among these layers, even further preference is given in turn to layers which have been produced using $[In_5(\mu_5\text{-}O)(\mu_3\text{-}O^iPr)_4(\mu_2\text{-}O^iPr)_4(O^iPr)_5]$ as the sole metal oxide precursor.

The at least one metal oxo alkoxide is preferably present in proportions of 0.1 to 15% by weight, more preferably 1 to 10% by weight, most preferably 2 to 5% by weight, based on the total mass of the anhydrous composition.

The anhydrous composition further contains at least one solvent, i.e. the composition may contain either a solvent or a mixture of different solvents. Useable with preference in the formulation for the process according to the invention are aprotic and weakly protic solvents, i.e. those selected from the group of the aprotic nonpolar solvent, i.e. of the alkanes, substituted alkanes, alkenes, alkynes, aromatics without or with aliphatic or aromatic substituents, halogenated hydrocarbons, tetramethylsilane, the group of the aprotic polar solvents, i.e. of the ethers, aromatic ethers, substituted ethers, esters or acid anhydrides, ketones, tertiary amines, nitromethane, DMF (dimethylformamide), DMSO (dimethyl sulphoxide) or propylene carbonate, and the weakly protic solvents, i.e. the alcohols, the primary and secondary amines and formamide. Solvents usable with particular preference are alcohols, and also toluene, xylene, anisole, mesitylene, n-hexane, n-heptane, tris(3,6-dioxaheptyl)amine (TDA), 2-aminomethyltetrahydrofuran, phenetole, 4-methylanisole, 3-methylanisole, methyl benzoate, N-methyl-2-pyrrolidone (NMP), tetralin, ethyl benzoate and diethyl ether. Very particularly preferred solvents are methanol, ethanol, isopropanol, tetrahydrofurfuryl alcohol, tert-butanol and toluene, and mixtures thereof.

To achieve particularly good printability, the composition used in the process according to the invention preferably has a viscosity of 1 mPa·s to 10 Pa·s, especially 1 mPa·s to 100 mPa·s, determined to DIN 53019 parts 1 to 2 and measured at 20° C. Corresponding viscosities can be established by adding polymers, cellulose derivatives, or $SiO_2$ obtainable, for example, under the Aerosil trade name, and especially by means of PMMA, polyvinyl alcohol, urethane thickeners or polyacrylate thickeners.

The substrate which is used in the process according to the invention is preferably a substrate consisting of glass, silicon, silicon dioxide, a metal oxide or transition metal oxide, a metal or a polymeric material, especially PI or PET.

The process according to the invention is particularly advantageously a coating process selected from printing processes (especially flexographic/gravure printing, inkjet printing, offset printing, digital offset printing and screen printing), spraying processes, rotary coating processes ("spin-coating"), dipping processes ("dip-coating"), and processes selected from meniscus coating, slit coating, slot-die coating and curtain coating. The printing process according to the invention is most preferably a printing process.

After the coating and before the conversion, the coated substrate can additionally be dried. Corresponding measures and conditions for this purpose are known to those skilled in the art.

The conversion to a metal oxide-containing layer can be effected by a thermal route and/or by irradiation with electromagnetic, especially actinic, radiation. Preference is given to converting by a thermal route by means of temperatures of greater than 150° C. Particularly good results can be achieved, however, when temperatures of 250° C. to 360° C. are used for conversion.

Typically, conversion times of a few seconds up to several hours are used.

The thermal conversion can additionally be promoted by injecting UV, IR or VIS radiation or treating the coated substrate with air or oxygen before, during or after the thermal treatment.

The quality of the layer obtained by the process according to the invention can additionally be improved further by a combined thermal and gas treatment (with $H_2$ or $O_2$), plasma treatment (Ar, $N_2$, $O_2$ or $H_2$ plasma), laser treatment (with wavelengths in the UV, VIS or IR range) or an ozone treatment, which follows the conversion step.

The invention further provides metal oxide-containing layers producible by means of the process according to the invention. Indium oxide-containing layers producible by means of the process according to the invention have particularly good properties. Pure indium oxide layers producible by the process according to the invention have even better properties.

The metal oxide-containing layers producible by means of the process according to the invention are advantageously suitable for the production of electronic components, especially the production of transistors (especially thin-film transistors), diodes, sensors or solar cells.

The example which follows is intended to illustrate the subject-matter of the present invention in detail.

WORKING EXAMPLE

A doped silicon substrate with an edge length of about 15 mm and with a silicon oxide coating of thickness approx. 200 nm and finger structures composed of ITO/gold was coated with 100 μl of a 5% by weight solution of $[In_5(\mu_5\text{-}O)(\mu_3\text{-}O^iPr)_4\ (\mu_2\text{-}O^iPr)_4(O^iPr)_5]$ in alcohol (methanol, ethanol or isopropanol) or toluene by spin-coating (2000 rpm). In order to exclude water, dry solvents (with less than 200 ppm of water) were used, and the coating was additionally performed in a glovebox (at less than 10 ppm of $H_2O$). After the coating operation, the coated substrate was heat treated under air at a temperature of 260° C. or 350° C. for one hour.

The inventive coating exhibits a charge carrier mobility of up to 6 $cm^2/Vs$ (at gate-source voltage 30 V, source-drain voltage 30 V, channel width 1 cm and channel length 20 μm).

TABLE 1

Charge carrier mobilities

| | Charge carrier mobility | |
|---|---|---|
| Solvent | 260° C. | 350° C. |
| Methanol | 0.2 | 1.0 |
| Ethanol | 0.6 | 6.0 (Sample 1) |
| Isopropanol | 0.4 | 1.3 |
| Toluene | 0.2 | 0.6 |

The invention claimed is:

1. A process for producing a metal oxide-containing layer, the process comprising applying an anhydrous solution to a substrate, optionally drying a resulting coated substrate and converting a coating formed from said anhydrous solution to form a metal oxide-containing layer, wherein the anhydrous solution comprises:

i) a metal oxo alkoxide of formula (I):

$$M_xO_y(OR)_z[O(R'O)_cH]_aX_b[R''OH]_d \quad \text{(I)},$$

wherein x=3-25,
y=1-10,
z=3-50,
a=0-25,
b=0-20,
c=0-1,
d=0-25,

M=In, Ga, Sn, Zn, or a mixture thereof,

R, R', R" individually represent an organic radical,

X=F, Cl, Br, or I; and ii) a solvent.

2. The process of claim 1, wherein the metal oxo alkoxide is an oxo alkoxide of formula (II):

$$M_xO_y(OR)_z \quad \text{(II)},$$

wherein x=3-20, y=1-8, z=1-25, and

OR=C1-C15-alkoxy, -oxyalkylalkoxy, -aryloxy- or -oxyarylalkoxy group.

3. The process of claim 2, wherein the metal oxo alkoxide is selected from the group consisting of $[In_5(\mu_5\text{-}O)(\mu_3\text{-}O^iPr)_4(\mu_2\text{-}O^iPr)_4(O^iPr)_5]$, $[Sn_3O(O^iBu)_{10}(^iBuOH)_2]$, $[Sn_6O_4(OR)_4]$, or a mixture thereof.

4. The process of claim 1, wherein the metal oxo alkoxide is the only metal oxide precursor in the process.

5. The process of claim 1, wherein the metal oxo alkoxide is present in a proportion of 0.1 to 15% by weight, based on a total mass of the anhydrous solution.

6. The process of claim 1, wherein the solvent is an aprotic or weakly protic solvent.

7. The process of claim 1, wherein the solvent is at least one selected from the group consisting of methanol, ethanol, isopropanol, tetrahydrofurfuryl alcohol, tert-butanol and toluene.

8. The process of claim 1, wherein the anhydrous solution has a viscosity of 1 mPa·s to 10 Pa·s.

9. The process of claim 1, wherein the substrate comprises at least one selected from the group consisting of glass, silicon, silicon dioxide, a metal oxide, a transition metal oxide, a metal and a polymeric material.

10. The process of claim 1, wherein the anhydrous solution is applied to the substrate by a printing process, a spraying process, a rotary coating process, a dipping process, or a process selected from the group consisting of meniscus coating, slit coating, slot-die coating and curtain coating.

11. The process of claim 1, further comprising:

heating the resulting coated substrate at temperatures greater than 150° C.

12. The process of claim 11, further comprising:

irradiating the resulting coated substrate with UV, IR or VIS radiation before, during or after the heating.

13. The process of claim 2, wherein x=3-15, y=1-5, z=10-20, and

OR=$-OCH_3$, $—OCH_2CH_3$, $—OCH_2CH_2OCH_3$, $—OCH(CH_3)_2$ or $—O(CH_3)_3$.

* * * * *

UNITED STATES PATENT AND TRADEMARK OFFICE

CERTIFICATE OF CORRECTION

PATENT NO. : 9,309,595 B2
APPLICATION NO. : 13/390840
DATED : April 12, 2016
INVENTOR(S) : Juergen Steiger et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 807 days.

This patent is subject to a terminal disclaimer.

On the Title Page item (45) should read:

(45) **Date of Patent: *Apr. 12, 2016**

Signed and Sealed this
Fifth Day of July, 2016

Michelle K. Lee

Michelle K. Lee
*Director of the United States Patent and Trademark Office*